United States Patent [19]

Hottel

[11] 4,403,785

[45] Sep. 13, 1983

[54] MONOSKI AND RELEASABLE BINDINGS FOR STREET SHOES MOUNTABLE FORE AND AFT OF THE SKI

[76] Inventor: John M. Hottel, 11 Broad Cove Rd., P.O. Box 35, Hingham, Mass. 02043

[21] Appl. No.: 270,387

[22] Filed: Jun. 4, 1981

Related U.S. Application Data

[63] Continuation of Ser. No. 3,171, Jan. 15, 1979, abandoned.

[51] Int. Cl.[3] ..... B62B 13/06; A63C 5/04

[52] U.S. Cl. ..... 280/12 H; 280/607; 280/609; 280/633

[58] Field of Search ..... 280/601, 606, 600, 609, 280/633, 636, 607, 12 H, 16, 11.1 BT, 18, 611, 617, 618, 604; 441/70, 74

[56] References Cited

U.S. PATENT DOCUMENTS

| | | | |
|---|---|---|---|
| 2,829,902 | 4/1958 | Stocker | 280/18 |
| 2,955,300 | 10/1960 | Hedlund | 280/618 |
| 3,088,748 | 5/1963 | Malmo | 280/606 |
| 3,854,743 | 12/1974 | Hansen | 280/618 |
| 3,900,204 | 8/1975 | Weber | 280/607 |
| 4,141,570 | 2/1979 | Sudmeier | 280/607 |

FOREIGN PATENT DOCUMENTS

| | | | |
|---|---|---|---|
| 704211 | 2/1941 | Fed. Rep. of Germany | 280/604 |
| 801817 | 7/1949 | Fed. Rep. of Germany | 280/609 |
| 1075477 | 2/1960 | Fed. Rep. of Germany BT | 280/11.1 |
| 2801859 | 1/1978 | Fed. Rep. of Germany | 280/12 H |

*Primary Examiner*—David M. Mitchell
*Assistant Examiner*—Timothy Roesch
*Attorney, Agent, or Firm*—Dahlen & Gatewood

[57] ABSTRACT

A monoski and releasable bindings for mounting thereon in fore and aft location are provided. The monoski bottom running surface is divided into two running surfaces separated by an intermediate channel which is not only deeper at the front end than at the back end but is also wider at the front end than at the back end. The releasable bindings permit a skier to wear conventional shoes rather than the usual stiff ski boots, permitting free movement of the skier's ankles and his feet to rotate horizontally and to pivot up and down, to maintain balance. The releasable bindings are mounted to slide back and forth lengthwise along the upper surface of the ski, the lengthwise movement being controlled by a breaking means mounted in association with the bindings.

14 Claims, 8 Drawing Figures

MONOSKI AND RELEASABLE BINDINGS FOR STREET SHOES MOUNTABLE FORE AND AFT OF THE SKI

This is a continuation, of application Ser. No. 003,171 filed Jan. 15, 1979 now abandoned.

BACKGROUND OF THE INVENTION (1) Field of the Invention

The invention relates to a monoski for snow, and to the particular binding used with the ski for securing a skier's feet in fore and aft relationship.

(2) Description of the Prior Art

Surfboarding is a popular recreation, in particular along the California coastline and Hawaii. In surfboarding, the surfboarder is supported on an elongated board or platform, with his feet spaced apart and at an angle to the longitudinal axis of the board. Surfboarding requires a keen sense of balance and rhythm and a surfer must have unlimited ankle movement to maintain his balance on the surfboard in wave riding.

In recent years, skateboarding has become popular, particularly with those in their teens and early twenty's. The action of the skateboard is somewhat akin to that of a surfboard. A skateboard floats, so-to-speak, being supportd by trucks located fore and aft, to each of which are mounted two wheels. The skateboarder stands on the skateboard, taking a stance similar to a surfer on a surfboard, with his feet spaced apart and at an angle to the longitudinal axis of the skateboard. A skateboarder, like a surfboard rider, must have a keen sense of balance and rhythm and unlimited ankle movement to maintain that balance.

Over the last severl years, downhill skiing has become an ever increasingly popular form of recreation. And some skiiers who have become proficient with conventional two runner skiing have ventured on to the challenge offered by monoskiing. In the case of two runner skiing, each skier's boot is supported by, and is attached to, a ski in fixed location on the ski by a releasable binding; the binding providing the skier's boot in longitudinal alignment with the ski, and fall line. The conventional ski binding holds the ski boot bottom or sole, which is rigid and is in general provided with a flat surface, in contact with the planar top surface of the ski, and maintains the boot in a low profile to the bottom or travelling surface of the ski. The downhill ski boot is stiff and, as it extends above the skier's ankle, provides unity of movement between the ski, foot, and ankle.

A monoski, in general, is a single ski or runner provided with one or more platforms for supporting both of a skier's boots. These platforms can be of various constructural configuration as exemplified in U.S. Pat. Nos. 3,685,846; 3,802,714; and 3,929,344. As shown in these patents, the platform supports on the ski are provided with two pairs of releasable ski bindings fixed to the platform in side-by-side arrangement. This arrangement places the skier's boots, as with two runner skiing, in alignment with the longitudinal axis of the ski, and the fall line.

A somewhat different monoski than those shown in the above-indicated patents is disclosed in U.S. Pat. No. 3,900,204. In that patent there is disclosed a monoski on which releasable ski boot bindings are provided, fore and aft, to place the skier's feet at an angle with respect to the longitudinal axis of the ski. Thus, the skier's stance is somewhat like that of a surfer or a skateboarder. While the ski itself is somewhat different than the usual downhill ski, e.g., its width is at least as great as a ski boot length, the ski bindings disclosed for use with the ski are the commercially available Spademan binding. These ski bindings maintain the skier's boots in contact with the top surface of the monoski as usual, and, as conventional ski boots are used, do not permit the skier to have freedom of ankle movement, as is needed in the case of surfing and skateboard riding. Accordingly, the skier does not get the same action on this monoski as a surfer in wave riding or a skateboarder in skateboard riding.

More recently there has become available a so-called "ski board, " i.e., a runner of particular design, to which can be attached a skateboard. This is accomplished, in general, by removing the skateboard wheels from the trucks, after which a ski board is attached to each skateboard truck. While the performance of this particular skiing device is satisfactory to a degree, the performance attained is not totally satisfactory. It is somewhat difficult to adjust the trucks to turn easily, and still not feel sloppy, to achieve the desired sensation while "skateboarding" on snow.

SUMMARY OF THE INVENTION

In accordance with the more basic aspects of the present invention, there is provided a monoski which provides the skier with the sensation of surfboard or skateboard riding, except that the action is taking place downhill on snow.

The monoski of the invention in general comprises an elongated runner of unique configuration, on the top planar surface of which is mounted, in fore and aft position with respect to the longitudinal axis of the runner, a pair of releasable bindings of novel construction providing means to secure a skier's conventional walking shoes or boots to the runner surface whereby freedom of ankle movement is permitted for maintaining one's balance as in skateboarding and surfboard riding.

The monoski of the invention in its more specific aspects comprises an elongated runner having a divided bottom running surface, a channel extending down the center line of the runner dividing the two running surfaces and a top surface at least planar in its middle portion, a pair of releasable, rotable bindings mounted on said top surface in fore and aft position, said bindings capable of providing the longitudinal axis of the skier's boots or shoes at a desired acute angle to the longitudinal axis of the runner and permitting freedom of ankle movement whereby one's balance can be maintained. The channel or trough is in general of lesser depth at the back of the monoski than at the front allowing for better planing of the runner on snow.

In a more preferred aspect of the invention, the bindings are mounted to move in a controlled, limited movement longitudinally of the runner lengthwise axis, providing additional means to control one's downhill speed.

BRIEF DESCRIPTION OF THE DRAWINGS

The features of the invention will be better understood by reference to the accompanying drawing in connection with reading the specification in which.

DETAILED DESCRIPTION OF THE INVENTION AND THE PREFERRED EMBODIMENTS

Figure 1:
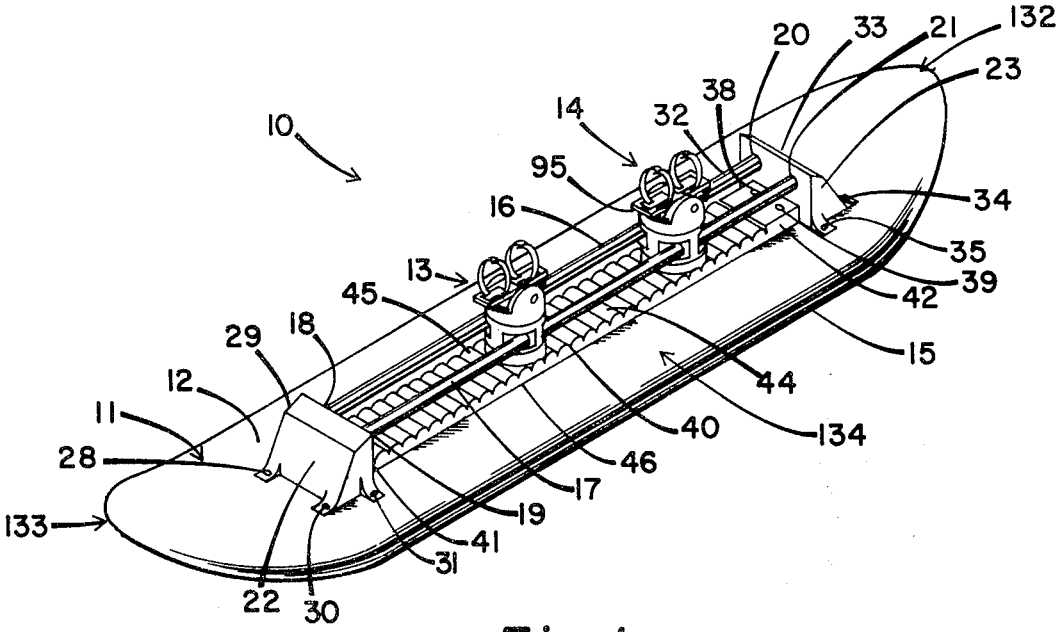
FIG. 1 is a view in perspective of one embodiment of a monoski in accordance with the invention, showing the rotable bindings in their normal position of rest i.e., facing along the longitudinal axis of the runner.

Turning now to the drawing, there is shown in FIG. 1 thereof a monoski 10 in accordance with the invention comprising an elongated runner 11 having an upper surface 12 on which is mounted, in fore and aft location, in relationship to the longitudinal axis of the runner 11, releasable, rotatable ski bindings, generally referred to by reference numberals 13 and 14, and a divided bottom or running surface 15.

Ski bindings 13 and 14, as shown in the drawing, and as hereinafter more fully described, are not only rotable but are, mounted for releasable movement back and forth a limited distance along the longitudinal axis of runner 11, on elongated, cylindrical-shaped, spaced-apart slide bars 16,17, the ends 18,19,20, and 21 of which are fixedly secured in slide bar support members 22,23 in dead end cylindrical bores 24,25 (slide bar support member 22, but not shown) and 26,27, respectively. Slide bars 16 17 are provided parallel to one another and in the same plane, this plane being parallel to the middle longitudinal portion of upper surface 12 of elongated runner 11 which is also planar (see FIG. 3) Slide bars 16,17 are parallel to the longitudinal axis (not shown) of runner 11 and are located equi-distant on opposite sides thereof.

Slide bar support members 22,23 as shown in the drawing, are secured to upper surface 12 of the runner by means of conventional screw type fastener 28,29 (not shown) 30,31 and 32,33,34,35, respectively, which pass via screw holes 28', 29',30', and 31'; and 32',33',34', and 35', respectively, in the slide bar support members 22,23 into the upper surface 12 of runner 11 into screw holes 28",29",30" and 31"; and 32",33",34", and 35". Only screw holes 35', 34" and 35" are shown in the drawings for sake of clarity; however, the respective location of these holes will be evident from reference to FIGS. 1 and 3 of the drawing.

Intermediate slide bar support members 22,23 is mounted, by means of screw type fasteners 36,37 (not shown) and 38,39, a braking track 40, an elongated rectangular shaped member of suitable thickness and having ends 41,42 in the latter of which are provided openings 38', 39' for passage of fasteners 38, 39. Braking track 40 is provided between ends 41,42 on its upper surface 43, with a plurality of uniform undulations 44 which extend laterally from longitudinal edge 45 of braking track 40 to longitudinal edge 46. The planar bottom surface 47 of braking track 40 is mounted directly against the planar middle portion of upper surface 12 of runner 11, this being accomplished so that the longitudinal axis of braking track 40 coincides with that of the elongated runner. As indicated in the drawing, braking track 40 is mounted so that it is centered lengthwise of runner 11.

Figure 3:
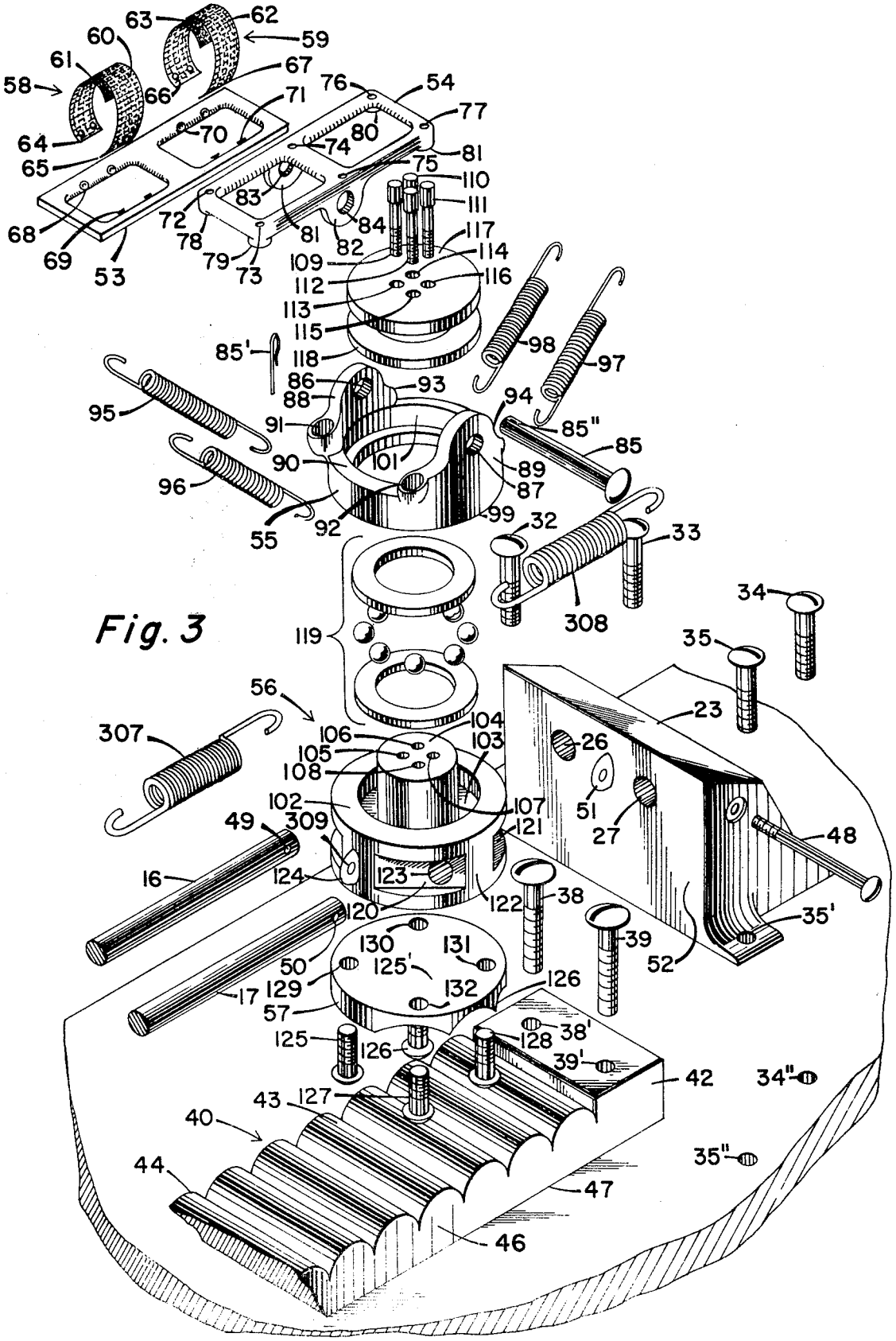
FIG. 3 is a perspective exploded view showing the rearward binding of the monoski in FIG. 1.

Slide bar support members 22,23 are each provided with threaded seat pins, these being indicated only in FIG. 3 with reference to that larger view by reference numeral 48, for securing the ends of slide bars 16,17, into the bores in slide bar support members 22,23. Slide bars 16,17 which as indicated in the drawing, are of tubular construction, are provided in their respective ends with holes such as indicated by reference numbers 49,50 in the ends of slide bars 16, 17 (FIG. 3) for passage of the associated seat pins. it will be appreciated, though not shown, from reference to FIG. 3 that a seat pin similar to that identified by reference numeral 48 is provided at the opposite end of slide bar support member 23. Similar seat pins are also provided in slide bar support member 22.

Each of the slide bar support members is provided on its planar front face, in addition to the dead end cylindrical bores for the ends of the slide bars 16,17, with an eye or ring, for example ring 51, the purpose of which will be later made clear. These rings depend outwardly from the planar surface of the support members as shown in FIG. 3, intermediate and in the same plane as the slide bars. The front planar surfaces of support members 22,23 abut with the end of the braking track 40. Thus, slide bar support members 22,23 are mounted on the top surface 12 of runner 11 so that their planar surfaces, e.g., surface 52, are lateral to the longitudinal axis of the runner and these surfaces are parallel to one another.

Ski bindings 13 and 14 are of identical construction and, accordingly, reference will be made only to one; however, it will be appreciated that the same description applies to the other as well. In describing the ski binding construction of the invention, reference is made to ski binding 14, the exploded perspective view of which is shown in FIG. 3 of the drawing. Ski binding 14, as shown comprises a foot plate 53 for supporting the sole of a skier's shoes or boots, a foot pivot plate 54 for detachably supporting foot plate 53, a rotatable top member 55 for pivotably and rotatably supporting foot pivot plate 54, a bottom member 56 for supporting rotatable top member 55 and which permits movement of the binder in a lengthwise direction of the runner, and a braking pad 57 for association with braking track 40, for controlling the lengthwise movement of the binder.

Foot plate 53, as shown in the drawing, is provided with two spaced apart strap members 58,59 providing releasable connection with a skier's shoes or boots. These strap members each comprise two straps the free ends 60,61 and 63,62 of which over-lap as shown in the drawing. The over-lapping free ends are provided with fastening means providing secure but releasaeble connection between the free ends. Various means can be used for this purpose; however, the hook and loop fasteners such as Velcro fasteners will be found most satisfactory. The straps can be constructed from various materials, e.g. woven webbing commonly used for strapping means, laminated materials, or leather as desired. The other ends (64,65 and 66,67) of the straps 58,59 are connected with commercially available snap type releaseable fasteners identified generally by reference number 68,69,70,71 to foot plate 53. As indicated in the drawings two fasteners are provided for each strap; however, more or less can be provided, as desired. Other releasable fasteners can be used, of course, instead of the snap-type fasteners shown and, if desired, the ends of the straps can even be more permanently fastened to foot plate 53.

As disclosed earlier, one of the chief characteristics of the binder according to the invention is that it permits complete freedom of ankle movement to maintain one's balance. This results in a performance sensation similar to skateboarding and surf board riding, except that the action is taking place on snow. The binder of the invention requires no specially designed shoes or boots, conventional walking shoes or boots being entirely satisfactory in the practice of the invention. Most importantly however, is that boots which inhibit ankle movement such as the conventional downhill ski boots cannot be worn, as these restrict the needed freedom of ankle movement.

Strap members 58,59 can obviously be of somewhat different construction, as desired. The front strap 58 fitting over the toe of one's shoe can be of the construction shown, and the back strap member 59 made of somewhat different configuration, e.g., providing a combination heel and ankle strap of a configuration found in roller skates.

As will be appreciated strap members 58,59 will adequately secure a skier's boot to the ski binding 14, yet permit freedom of ankle movement and disconnection of the overlapping strap members and the freeing of one's shoe or boot in the event of a fall. While somewhat less desirable, due to provision of a somewhat less safety factor, the free ends of the strap can be joined by conventional buckle means, if desired, and the other ends secured to the foot plate by rivets.

Foot plate 53 is seen to be of a rectangular, skeletal configuration; however it can be a solid plate, if desired, e.g., rectangular or even in the shape of a shoe sole. The skeletal construction, however, makes for a somewhat lighter foot plate. The foot plate should be of such a dimension as to provide complete support to a persons' foot, depending somewhat on the size of one's shoe or boot.

The pivotal foot plate 54 provides detachable support to foot plate 53, as shown, and is desirably also of skeletal construction for weight savings. As indicated generally by reference numerals 72,73,74,75,76, and 77 the connection between these two members can be provided by means of the usual snap type fasteners. The mating portions of the snap-type fastener are provided in corresponding locations on the underneath side of foot plate 53. The fasteners can be secured to the foot plate and foot pivot plate by various means, e.g., adhesive, soldering, brazing, etc., depending somewhat on the material of construction of these support plates. The four corners of foot pivot plate 54 are each provided with a cup or dead bore referred to by reference numerals 78,79, and 80,81, the purpose for which will be later explained. Intermediate the ends of foot pivot plate 54 and on the underneath sides thereof are provided flanges 81,82 integral with the pivot plate in which are provided circular shaped openings 83,84 through which passes pivot pin 85. Pivot pin 85 is secured in location by means of a cotter pin 85′ passing through opening 85″ in the end of the pin, according to usual techniques. However, it will be appreciated that the end of pivot pin 85 can be threaded and a corresponding self-locking thread can be provided in the flange on rotatable top member 55.

Foot pivot plate 54 as shown is mounted for pivotable movement up and down on top rotatable member 55 of binding 14. This is accomplished by passing pivot pin 85 through circular shaped openings 86, 87 in the semi-circular shaped flanges 88,89 respectively, depending vertically upwardly from and integral with, top surface 90 of top rotatable member 55. Near the ends of each flange 88,89 where the flange meets top surface 90 are provided cups or dead bores 91,92,93 and 94 the purpose of which will soon be explained. As seen from the drawing (FIG. 2) flanges 81,82 on foot pivot plate 54 fits within the upwardly depending flanges 88,89 of rotatable top member 55.

The pivotal movement of foot pivot plate 54 is controlled by means of four spaced apart action springs 95,96,97,98 the respective ends of which are located in dead bores 78,79,80 and 81 of foot pivot plate 54, and dead bores 91,92,93 and 94 of the top rotatable member 55. The ends of the springs can be secured by various convention means in their respective bores, e.g., mechanical fastening means, such as set screws, or adhesively secured. Coiled springs of various compression can be used depending on the action desired; however, the four springs used should be of the same compression, e.g., 10–30 lbs/in$^2$, preferably about 15 lbs/in$^2$. However, the particular springs chosen will depend to some extent on the skier's weight and ability.

The bottom planar surface 99 of top rotatable member 55 is provided with a cylindrical shaped recess 100 concentric with the cylindrical shaped rotatable member 55, the purpose for which will be obvious from the drawing. In top surface 90 is provided a circular shaped recess 101 of slightly larger diameter, concentric with recess 100. As indicated in the drawing, cylindrical-shaped bottom member 56 of the binder 14 is provided in its upper planar surface 102 with a cylindrical shaped recess 103 concentric with lesser diameter upwardly protruding cylindrical shaped member 104, and bottom member 56, the upwardly protruding member being integral with bottom member 56. The upwardly protruding member 104 is provided in its top planar surface with threaded openings 105,106,107, and 108, the purpose for which will soon be described.

Figure 2:
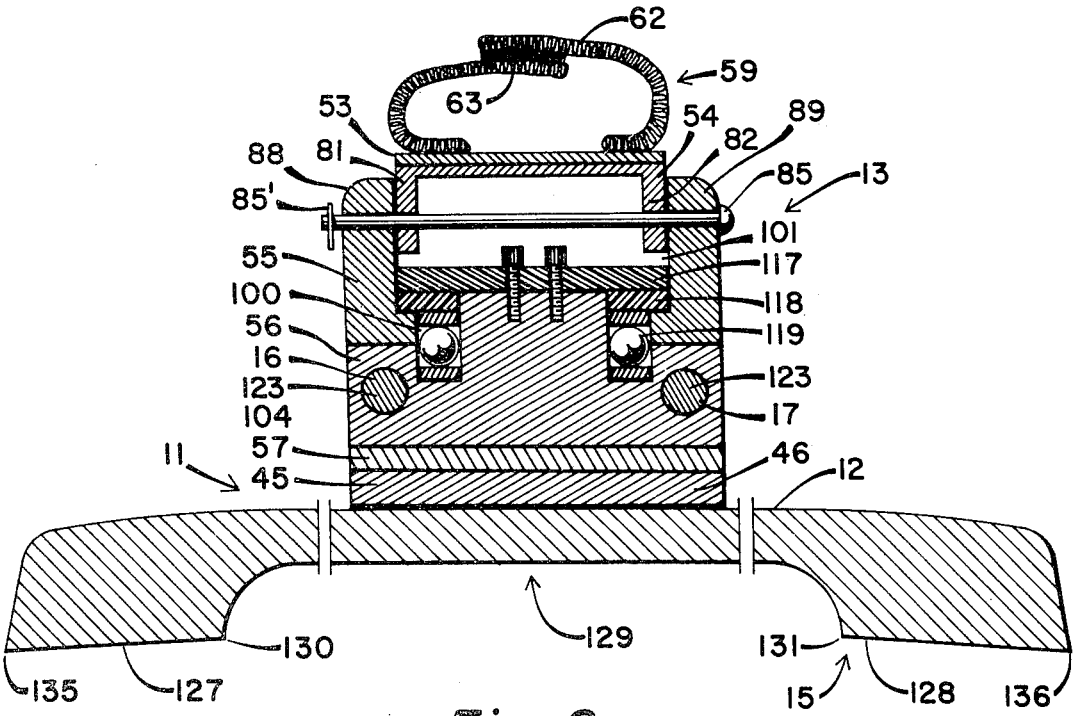
FIG. 2 is a view showing the front binding and runner in FIG. 1 in transverse cross-section.

When assembled as shown more clearly in FIG. 2 of the drawing upwardly protuding member 104 intrudes into bottom recess 100 in top rotatable member 55. The two members are held in operative association with one another by threaded fasteners 109, 110,111, and 112 which pass through circular shaped openings 113,114,115, and 116 in top bushing 117 and are threaded respectively into threaded opening 105,106,107 and 108 in the top surface of upwardly protruding member 104 of bottom member 56. Top bushing 117 fits into recess 101 and is supported by annular bushing 118 which surrounds the top of upwardly protruding member 104. As seen from the drawing, in particular FIG. 2, upwardly protruding, cylindrical shaped member 104 protrudes upwardly into recess 101 in the top rotatable member 55. Although four threaded fasteners are shown this is of no particular significance. One would do as well provided the members are securing fastened together. The relative dimensions of recesses 100 and 101 can obviously be varied from that shown. Thus, recess 100 can be of greater diameter nearer surface 99, if desired. In that case bearing member 119 can also be of larger diameter, contacting member 104 or not, as desired.

It will be appreciated by reference to FIGS. 2 and 3 that upwardly protruding member 104 provides an axis for rotation of top rotatable member 55. To aid in that rotation, a conventional bearing member 119 is provided which surrounds upwardly protruding member 104 (FIG. 2); a part of the bearing is in each recess 100,103. The bearings can be either of the open or sealed type, as desired.

In some instances it may be desirable to provide positive snap back action between top rotatable member 55 and bottom member 56. Thus, a coiled spring or other tension member can be connected, according to conventional techniques, between the top rotary member and the bottom member, which is fixed in relationship to the rotatable member. This will provide that, after rotatable member 55 is actuated to provide a skier's boot at a desired acute angle to the runner lengthwise direction, on removal of the actuating force, the spring will rotate the rotatable member to its position of rest as shown in FIG. 1. Springs providing various tension can be used, depending on the amount of snap back tension desired. The use of such a spring will, of course, prevent undesired rotation or too much rotation of the rotatable member. Appropriate stops can be provided between the rotatable top member 55 and bottom member 56 so that rotation can be further controlled. The springs can be mounted to provide the desired rotation in whichever direction desired, or dual springs can be provided to control rotation in either direction. In the latter case, the binding is obviously more universally usable, i.e., the skier can take a right or left standing stance, as desired.

In each side of bottom member 56 is provided a pair of cut-outs 120,121 separated by a web 122 in which is provided a cylindrical-shaped opening 123 extending completely through the web. A similar pair of cut-outs and cylindrical-shaped opening are provided in the other half of the cylindrical-shaped bottom member 56. As will be appreciated these tubular openings are in the same plane with one another and provide means for passage of cylindrical shaped slide bars 16,17 for mounting of this bottom member 56, for limited movement in the lengthwise direction of the runner 11.

To the bottom planar surface 124 of bottom member 56 is secured a braking pad 57 for operative engagement with braking track 40 for limiting the lengthwise movement of the binder. This can be accomplished by various means, e.g. screw fasteners or adhesive. However, in the practice of the invention threaded fasteners 125,126,127 and 128 have been used for this purpose. These fasteners pass through circular openings 129,130, 131, and 132, respectively in braking pad 57 and into appropriately located threaded openings (not shown) in the bottom planar surface 124 of bottom member 56. The top mating surface 125' of braking pad 57 is planar; however, its bottom surface 126 is provided with a plurality of uniform corrugations as shown. This corrugated surface is the reverse of that provided on the top surface 43 of braking track 40. Thus, while the corrugations 44 on braking track 40 are each provided with a rounded crest, the crests in the corrugated surface of the braking pad are sharp. In this way the two surfaces mate together as one, the crests in the one surface mating with the gulleys in the others. And when the two corrugated surfaces are in mating contact, the braking pad 57 is prevented from moving in the lengthwise direction of runner 11.

These corrugations can vary somewhat in size; the main consideration being uniformity. However, in general, a corrugation provided by a half cylindrical shape having a radius of $\frac{1}{4}$–178 inch will be found satisfactory. These corrugations can be provided on braking track 40 in slightly spaced apart location, so long as the spacing is uniform. In this way the mating crests on braking pad 57 need not be as sharp to fit into the mating gully on the braking track, making for less wear and longer life braking means.

While not quite as desirable as the mating corrugated or undulating surfaces, the braking action can be provided by mating surfaces offering high frictional forces with respect to one another. Thus, for example, one surface can be a woven fabric of high strength fibers, plastic or metallic, and the other surface, e.g., like a sandpaper surface. One of the surfaces could be provided with a multiplicity of small teeth like on a file and the other be a similar surface, or a biting surface of, e.g., leather.

The most desired braking surfaces, however, offer not only good sliding resistance to one another in the corrugated configuration shown, but rather low frictional properties overall. Materials providing these characteristics are, for example, nylon and polyacetal resins. These plastic materials are commonly used not only for strength but also their frictional properties. And they can easily be molded by conventional means into any desired configuration.

Figure 8:
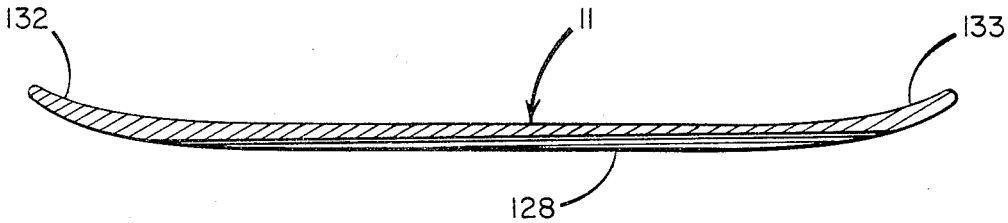
FIG. 8 is a longitudinal section of still another embodiment of a runner, showing the channel between the runners of greater depth at the front end than at the back.

Referring now to FIG. 2 of the drawing, it is seen that running surface 15 of runner 12 is divided, offering two parallel running surfaces 127, 128 extending lengthwise of the runner for contact with the snow. These two running surfaces are separated by a trough or channel 129 extending down the center line of the runner 12 in its longitudinal direction. Although channel 129 is shown to be somewhat of a U-shape in cross-section it will be appreciated that it can be of a more arcuate shape, if desired. A flat bottom U-shaped should be avoided, however, as this tends to allow snow build up in the channel. Edges 130,131 of channels 129 should be sharp raher than rounded, to facilitate turning. The channel or trough 129 in general should be of lesser depth at the back end 132 of the runner 12 than at its front end 133 (see FIG. 8) thus, allowing for better planing of runner 11 over snow. The exact dimensions of channel 129 for optimum performance will depend somewhat on the dimensions of the runner. And these, of course, will depend somewhat on the skier's weight, height and ability. However, as a general rule, satisfactory performance will be attained if the channel width at the toe end is between about 5–10 inches. The channel thickness can be tapered from about $1\frac{1}{2}$ at the toe end to about $\frac{1}{4}$ inch at end 132. The running surfaces can be each from about 3–$4\frac{1}{2}$ inches.

Figure 7:
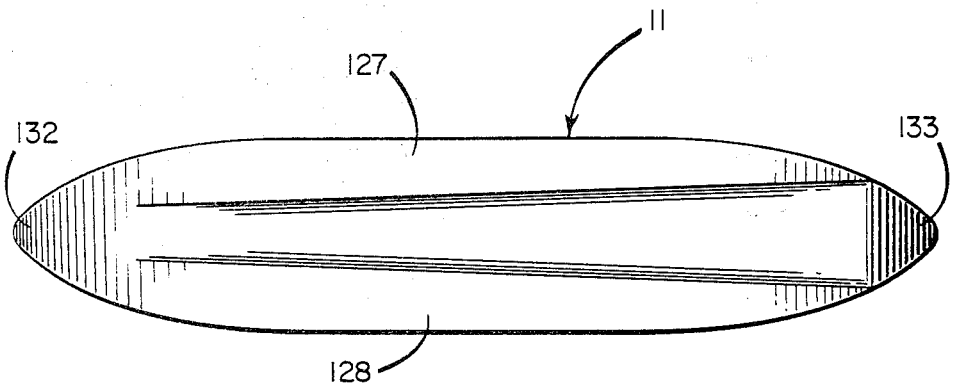
FIG. 7 shows a bottom plan view of a further and alternative embodiment of a runner according to the invention.

In some cases it may be found desirable to also provide a narrowing taper to the width of channel 129 from front end 133 to rear end 132 (FIG. 7). However, it is preferred that this width be constant the length of the running surface.

Runner 11 can be, of course, of various lengths and widths; however, the preferred length overall is between 4–6 feet, the turned up ends 132,133 each being about 10–14 inches, i.e., measuring from the running surfaces 127,128. The curvature of these ends can vary somewhat; however the ends should turn up somewhat gradually. The curved ends should blend in smoothly with the body of the runner; a curve made by a six foot radius circle will be found satisfactory. The most desired width of runner 12 is between 14–16 inches and, in general, the thickness should be about $1\frac{3}{4}$ inches, more or less, depending on the materials of construction and desired performance. The thickness of ends 132,133 can be tapered to about $\frac{1}{2}$ inch thick. The intermediate section 134 of runner 11, i.e., that portion between ends 132, 133 is generally of rectangular configuration, the bottom edges 135 and 136 of which can be provided with metal edge trim, as is conventionally done in ski manufacture. Thus, there is provided an edge that can be sharpened for maintaining a good edge for cutting into the snow for turning. Such a metal edge can also be provided on edges 130,131 on channel 129 for better control in turning.

Ends 132 and 133 or, as more commonly termed by skiers, the heel and toe, of runner 11 can be somewhat rounded or brought more to a point, as desired. However the more pointed toe will provide overall better performance.

Running surfaces 127,128, though planar, do not lie in the same plane. These surfaces slope upwardly from the horizontal from their respective outer edges 135, 136, toward channel 129. The angle of this slope can vary somewhat but in general will be only about 1–2 degrees. As disclosed earlier, it is preferred that the width of these running surfaces be the same, front to back. Each runner shoud be at least no less than about 3 inches wide, otherwise the runner will not plane as desired.

The upper surface 12 of runner 11 should be planar horizontally, at least in the middle portion thereof, to provide a suitable base for mounting braking track 40. On each side of the middle portion the top surface 12 can taper downwardly slightly, as shown more clearly in FIG. 2 of the drawing, if desired.

As in the case of conventional downhill skis, the elongated runner of the invention can be of various materials and construction depending to a great extend upon the skill of the intended user. The runner can be manufactured with various degrees of flexibility, camber, torsion, etc. That combination of characteristics built into any particular runner should best utilize the user's size, weight and athletic ability.

Runner 11 can be manufactured of e.g., laminated metal layers, e.g., aircraft metal, glass fiber reinforced plastic lamina, and combinations of metal lamina, glass fiber reinforced lamina, plastic or rubber foam cores, and metal honey comb. These materials are well known in the ski industry as is their use in various combinations to provide a ski of some desired combination of characteristics.

Slide bar support members 22,23 should be centered on top surface 12 of runner 11, intermediate ends 132, 133. These locations will depend somewhat on the length of slide bars 16, 17; however, the length of these bars in general will be from 4–6 feet, essentially the length of intermediate section 134, less the space needed to mount the slide bar support member.

Although slide bars 16,17 are disclosed as tubular, it will be appreciated that solid rods can be used in the practice of the invention, if desired. Moreover, these bars need not be cylindrical, and can be of polygonal shape, if desired. Whatever the shape, the slide bars should provide low frictional characteristics for optimum sliding of binders 13,14 along their lengths. To better accomplish this, low frictional tubular inserts can be provided in the circular openings in bottom members 56, providing contact with the slide bars. The slide bars can be either of metal or suitable plastic material, e.g., a reinforced plastic.

In use, a skier positions straps 58,59 about his shoes and ankles, after positioning binders 13,14 about 8–10 inches apart, the front binder 13 being positioned lengthwise near the center of the board. The rotatable members 55 are rotated counter clockwise so as to provide the toes of one's shoes at an acute angle with the board's lengthwise direction, i.e., about 20°–30° with respect to the center line and front end of the runner. On moving downhill on the runner one shifts his weight rotatably as well as longitudinally of the ski to provide the desired maneuverability and balance. In regard to this, a skier may shift his weight transversely to place pressure on an edge as desired, as in conventional downhill skiing, to relieve pressure on the other bottom edge, to make an appropriate turn.

Moving the binders lengthwise of the runner controls downhill speed somewhat; the further back one sits on the ski, the greater the speed. Usually braking pad 57 and braking track 40 are in mating contact with one another, preventing movement of the binder on the slide bars. However, during unweighting by the skier, these two members are momentarily out of contact with one another to allow the binders to move along the slide bars in the direction desired.

Figure 4:
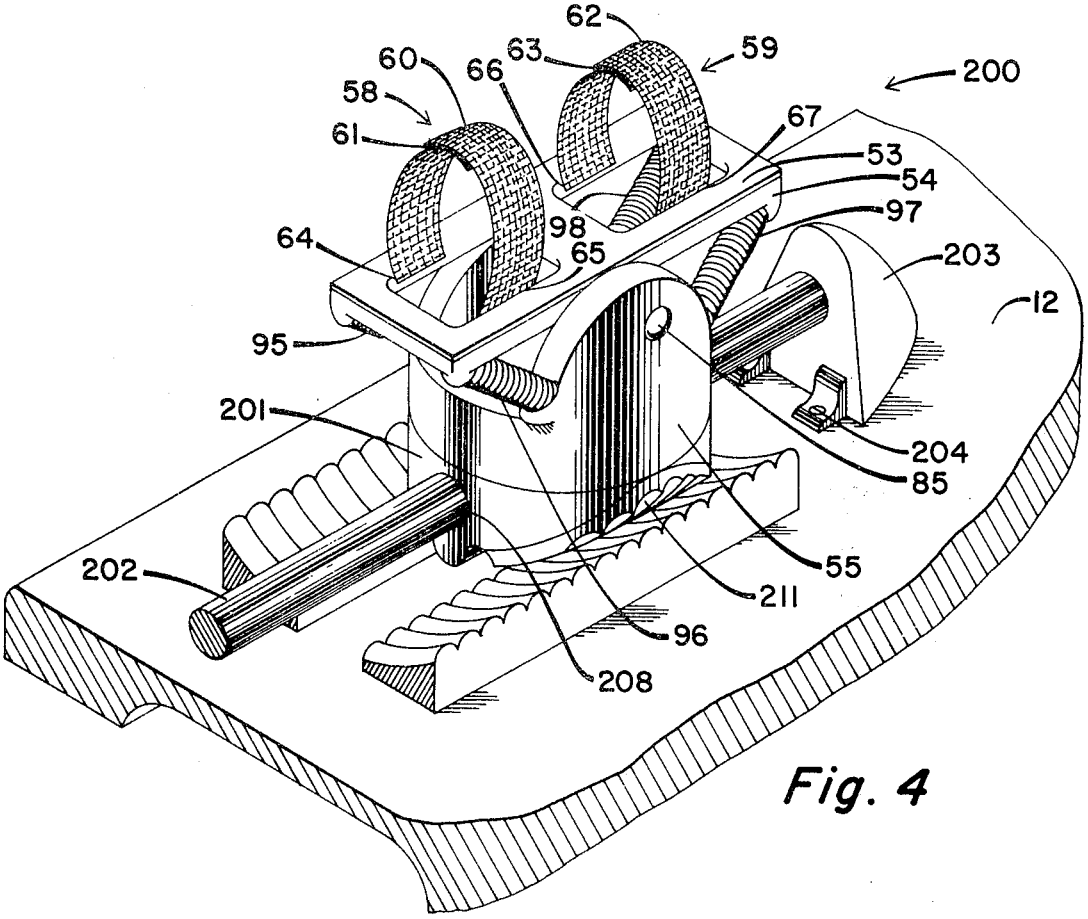
FIG. 4 is a perspective view of a monoski according to the invention showing a different construction of binding.
Figure 5:
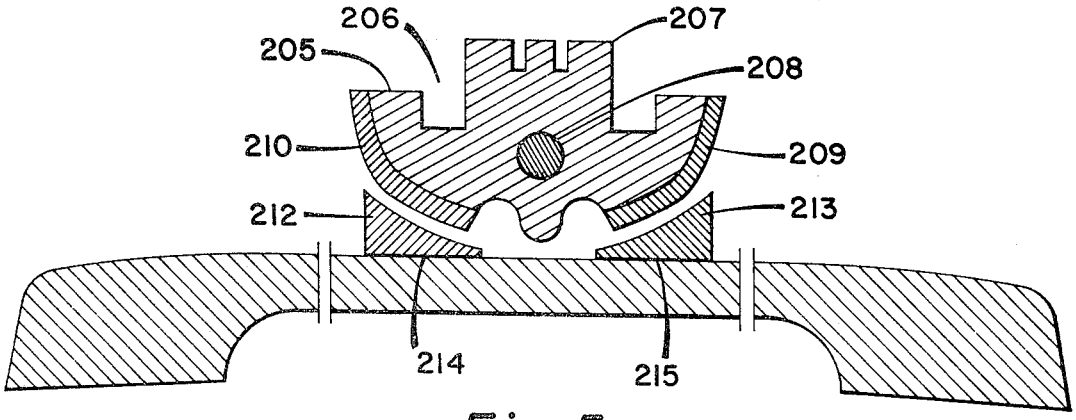
FIG. 5 is a view in cross-section of the monoski in FIG. 4, showing only the bottom member of the binding and the associated braking track.

Turning now to FIGS. 4 and 5 of the drawing there is shown therein another embodiment of a monoski 200 in accordance with the invention. As shown in FIG. 4, the top rotatable member 55 of the binding and its associated components is of the same configuration as in the case of the binder earlier disclosed in FIG. 3. The difference resides in the means for braking, i.e., controlling movement lengthwise of the binder along the runner, and in mounting the bottom member 201 of the binder for longitudinal movement along slide bar 202.

As indicated in the drawing (FIG. 4) slide bar 202 is supported at its ends, as in the case of slide bars 16, 17, by means of a slide bar support member only one of which is shown and which is indicated generally by a reference number 203. Each slide bar support member is appropriately fixed to the top surface 11 of runner 12 by means of screw fasteners on the like represented by reference numeral 204, according to usual techniques.

Bottom member 201 which is, in general, of a cylindrical shape is provided in its top planar surface 205 with a cylindrical shaped recess 206 in which is provided an upwardly protruding member 207 of cylindrical shape, of similar function as upwardly protruding member 104 in FIG. 3. Thus, as it functions in the same manner as rotatable member 55 and is of the same configuration, no further description is believed necessary.

In the lower portion of bottom member 201 is provided a tubular opening 208 extending diametrically from one side to the other of the bottom member, for passage of slide bar 202. Thus, it will be seem that bottom member 201 of binder 200 is capable of pivotable motions toward and away from top surface 12 of runner 11, as well as along its length. However, the axis of this pivotal motion does not coincide with, and is offset downwardly from that axis defining the divided cylindrical shaped bottom 209 of the bottom member 201. The reason for this will be shortly explained if not already obvious.

To each portion of bottom 209 there is secured by adhesive or other appropriate means a curved braking pad 210 having a corrugated surface 211, for braking association with the divided braking track comprising corrugated elongated track members 212, 213. These track members are provided with planar bottom surfaces 214,215 for mounting on the planar top surface 12 of runner 11, and on their respective top surface is provided a uniformly corrugated or undulating surface of the same overall curvature as bottom cylindrical surface 209. Thus, as the axis for pivoting bottom member 201 is not coincident with the axis for these curved surfaces, on pivoting the bottom 201, the braking pad will make braking contact with an associated corrugated surfaced braking track. These corrugated surfaces tend to mate and interlock within one another. In this way control of movement of the binders in a longitudinal direction is maintained, as desired.

Figure 6:
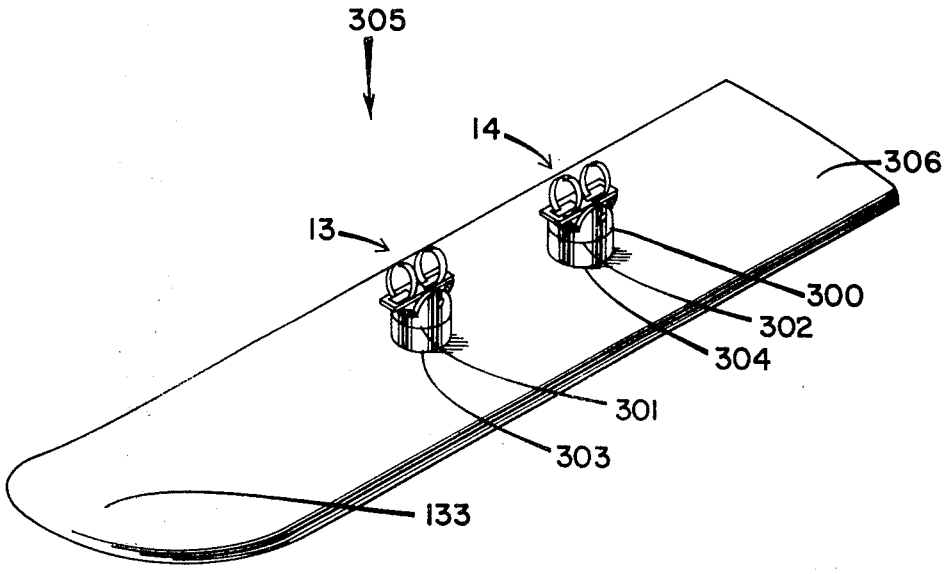
FIG. 6 shows a different construction of monoski in accordance with the invention in which the bindings are mounted in stationary fore and aft location.

A further embodiment of the invention is disclosed in FIG. 6 of the drawing. In that invention binders 13, and 14 in accordance with the invention are mounted fore and aft in fixed position, i.e., the binders cannot move in a lengthwise direction of the runner. This is accomplished by fastening planar bottom member 56 directly to planar top surfaces 300,301 of upright cylindrical posts 302,303. These top surfaces 300,301 are parallel to the planar upper surface 304 of runner 305. As the binders no longer move longitudinally on slide bars, it will be appreciated that bottom member 56 of the binder need not be provided with openings for passage of the slide bars.

The runner 305 can be of the same overall construction as runner 12 or be provided with a straight back end 306 as shown. The fixed positioning fore and aft of this binding will depend to some extend on the length of the runner; however, in general, it will be found that the front binding should be located at approximately the center of gravity of the runner. The rearward binding is best positioned 6–12 inches, center-to-center, from the front binding.

Posts 302,303, will, in general, provide the skier's foot about 2–3 inches above the top surface of the runner. Thus, the skier can better control his balance and the maneuverability of the ski and attain a performance similar to surfing and skateboarding.

Optionally, it may be desirable to provide additional control to the longitudinal movement of binders 13,14 on runner 11. Thus, as shown in FIG. 3 of the drawing, the binders can be connected to one another and to their respective slide bar support members 22,23 by means of springs, as represented by reference numerals 307,308. It will be appreciated that a third spring (not shown) will connect binder 13 to slide bar support member 22 These springs can be connected at their ends to rings such as represented by reference numeral 309 integral to bottom support member 56, and ring 51. There is, of course, two rings located on each support member 56, these being diametrically opposite one another. The rings, moreover, are suitably located on the support members 56 as to be in direct alignment longitudinally with the rings 51 on the slide bar support members 22,23.

As many different embodiments of this invention will now have occurred to those skilled in the art, it is to be understood that the specific embodiments of the invention as presented herein are intended by way of illustration only and are not limiting on the invention, but that the limitations thereon can be determined only from the appended claims.

What I claim is:

1. Monoski for use on snow comprising an elongated runner defined by a front and back end and having a top surface for supporting a skier's feet fore and aft and a bottom surface for running on the snow, said bottom surface consisting of two spaced-apart running surfaces extending lengthwise of the elongated runner, and a channel intermediate said running surfaces and extending down the longitudinal centerline of the runner deeper at the said front end of the runner than at the back end thereby providing in use better planing of the runner over snow, said spaced-apart running surfaces each comprising a planar surface for contacting the snow defined by inner and outer sharp edges, said outer edges defining the outer edges of the monoski and extending lengthwise of the runner, the said running surfaces sloping slightly upwardly from the horizontal from each said outer edge to each said inner edge, means for supporting releasable bindings being provided on said top surface comprising at least one elongated slide bar of predetermined length extending lengthwise of the runner, and means for supporting said at least one slide bar at its ends are mounted in spaced-apart locations on said top surface, said bindings being capable of movement lengthwise of the runner during use.

2. Monoski for use on snow according to claim 1 where said front and back ends turn up from the horizontal.

3. Monoski for use on snow according to claim 1 where said channel is of arcuate shape.

4. Monoski for use on snow according to claim 1 wherein said top surface comprises a planar surface.

5. Monoski for use on snow according to claim 4 wherein a braking means is mounted on said top planar surface in association with said at least one elongated slide bar for braking the movement longitudinally of releasable bindings mounted on the said at least one elongated slide bar.

6. Monoski for use on snow according to claim 5 wherein said braking means comprises an elongated rectangular-shaped braking track extending lengthwise of the runner, said braking track having an upper surface defined by longitudinal edges and comprising a plurality of uniform undulations extending laterally between said edges.

7. Monoski for use on snow according to claim 1 wherein the width of the channel is wider at the front end than at the rear end.

8. Monoski for use on snow comprising in combination an elongated runner having a top surface and a bottom surface, and a pair of bindings located on said top surface in fore and aft position suitable for releasably securing a skier's conventional street shoes or boots to the runner, the bottom surface of said runner comprising a divided running surface for contact with the snow, a channel intermediate said divided running surface having a greater depth at the front end of the runner than at the back end thereof providing the runner with good planing characteristics, each said binding being moveable in the lengthwise direction of the runner and comprising a foot plate providing pivotal support to the skier's shoes or boots in a direction up and down, means rotatable in a horizontal direction for rotatably supporting the pivotable foot support, and means supporting the rotatable means capable of movement in a lengthwise direction, elongated support means supported on the top surface of said runner associated with said means supporting the rotatable means along which said means supporting said rotatable means moves, first means for braking located on said runner in association with said elongated support means and second braking means located on each said means supporting the rotatable means on each said binding for association with said first braking means and controlling the lengthwise movement of each said binding on the runner.

9. Bindings for use on skis for releasably binding a person's foot to the ski surface and being capable of binding a person's ordinary street shoes or boots thereby permitting freedom of ankle movement comprising a first foot plate for supporting said person's shoes or boots, fastener means on said foot plate for securing the person's shoe or boot to the said first footplate, a second boot plate capable of pivotal movement in vertical direction for releasably and pivotally supporting the first said foot plate, means capable of rotation in a horizontal direction supporting said pivotal foot plates, spring means connecting said foot plate and said means capable of rotation whereby the pivotal movement of said first and second foot plates are controlled, and means supporting said rotatable means for mounting on a ski.

10. Bindings for use on skis for releasably binding a person's foot to the ski surface and being capable of binding a person's ordinary street shoes or boots thereby permitting freedom of ankle movement according to claim 9 whereby said means capable of rotation comprises a planar bottom surface having a cylindrical-shaped recess therein and said means supporting said rotatable means comprises a bottom member having a top planar surface and a second named bottom surface, and a cylindrical-shaped member extending upwardly vertically from said top surface which when the rotatable means is in operative assembly with said bottom member intrudes into and beyond said cylindrical-shaped recess.

11. Bindings for use on skis for releasably binding a person's boot to the ski surface and being capable of binding a person's ordinary street shoes or boots thereby permitting freedom of ankle movement according to claim 10 wherein braking means are provided on said second named bottom surface.

12. Bindings for use on skis for releasably binding a person's foot to the ski surface and being capable of binding a person's ordinary street shoes or boots thereby permitting freedom of ankle movement according to claim 11 wherein said second named bottom surface comprises a planar surface and said braking means comprises a braking pad having a plurality of uniform corrugations for making contact with the corrugated braking surface of the braking track mounted on a ski.

13. Bindings for use on skis for releasably binding a person's foot to the ski surface according to claim 9 wherein said means supporting said rotatable means comprises means to control lengthwise movement of the bindings when mounted on a ski.

14. Monoski for use on snow comprising an elongated runner defined by a front and back end and having a top surface for supporting a skier's feet fore and aft and a bottom surface for running on the snow, said bottom surface comprising two spaced-apart running surfaces extending lengthwise of the elongated runner, and a channel intermediate said running surfaces and extending down the longitudinal center line of the runner deeper at the said front end of the runner than at the back end thereby providing in use better planing of the runner over snow, said spaced-apart running surfaces each comprising a planar surface for contacting the snow defined by inner and outer sharp edges extending lengthwise of the runner and sloping slightly upwardly from the horizontal from each said outer edge to each said inner edge, means on said top surface for supporting releasable bindings for movement longitudinally of the monoski comprising at least one elongated slide bar of predetermined length extending lengthwise of the runner, and means for supporting said at least one slide bar at its ends are mounted in spaced-apart locations on said top surface, and a braking means mounted on said top surface in association with said at least one elongated slide bar for braking the movement longitudinally of said releasable bindings mounted on the said slide bars, said braking means comprising an elongated rectangular-shaped braking track extending lengthwise of the runner, said braking track having an upper surface defined by longitudinal edges and comprising a plurality of undulations extending laterally between said edges.

* * * * *

UNITED STATES PATENT AND TRADEMARK OFFICE

CERTIFICATE OF CORRECTION

PATENT NO. : 4,403,785

DATED : September 13, 1983

INVENTOR(S) : John M. Hottel

It is certified that error appears in the above-identified patent and that said Letters Patent are hereby corrected as shown below:

Column 8, line 6, "1/4-178" should read - 1/4-1/2 -.

Signed and Sealed this

*Twentieth* Day of *December 1983*

[SEAL]

*Attest:*

GERALD J. MOSSINGHOFF

*Attesting Officer*

*Commissioner of Patents and Trademarks*